US006043193A

United States Patent [19]

Chen et al.

[11] Patent Number: 6,043,193

[45] Date of Patent: Mar. 28, 2000

[54] THERMAL RECORDING ELEMENT

[75] Inventors: Huijuan D. Chen, Webster; Derek D. Chapman, Rochester; Richard A. Landholm, Canandaigua, all of N.Y.

[73] Assignee: Eastman Kodak Company, Rochester, N.Y.

[21] Appl. No.: 09/102,784

[22] Filed: Jun. 23, 1998

[51] Int. Cl.[7] ..... B41M 5/035; B41M 5/38

[52] U.S. Cl. ..... 503/227; 428/206; 428/327; 428/913; 428/914

[58] Field of Search ..... 8/471; 428/195, 428/913, 914, 206, 323, 327; 503/227

[56] References Cited

U.S. PATENT DOCUMENTS

| | | | |
|---|---|---|---|
| 2,739,909 | 3/1956 | Rosenthal | 117/161 |
| 4,929,590 | 5/1990 | Maruta et al. | 503/207 |
| 5,851,651 | 12/1998 | Chao | 428/327 |
| 5,919,558 | 7/1999 | Chao | 428/327 |

*Primary Examiner*—Bruce H. Hess
*Attorney, Agent, or Firm*—Harold E. Cole

[57] ABSTRACT

A thermal recording element consisting of a support having thereon a recording layer comprising hollow spherical beads dispersed in a hydrophilic binder, the beads having a mean diameter of about 0.2 $\mu$m to about 1.5 $\mu$m and a void volume of about 40% to about 90%.

14 Claims, No Drawings

THERMAL RECORDING ELEMENT

FIELD OF THE INVENTION

This invention relates to thermal recording elements, and more particularly to such elements which contain hollow beads in a polymeric binder for generating visual continuous tone images in a single-sheet process.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to generate an image in a thermal recording process is to use a direct thermal recording element which contains a material which, when heated with a thermal head, forms a visible image. In this process, there is no transfer of dye to a separate receiving element.

DESCRIPTION OF RELATED ART

U.S. Pat. No. 4,929,590 related to a thermosensitive recording material containing a thermosensitive coloring layer and an undercoat layer on a support. The undercoat layer contains spherical hollow particles (0.20–1.5 $\mu$m, and a voidage of 40–90%, and glass transition temperature of 40–90° C.) in a binder resin. The undercoat layer serves as a heat insulating layer which allows effective use of thermal energy provided by a thermal print head to improve the thermal color sensitivity. There is a problem with this element in that it requires two different layers to obtain an image which adds to the expense and complexity of the element.

U.S. Pat. No. 2,739,909 relates to a heat-sensitive recording paper by overcoating black-colored paper with a continuous thermoplastic resin material containing microscopic voids dispersed throughout the resin. The coating layer is opaque, but becomes transparent by the localized action of a stylus using either heat or pressure or both to disclose the black color of the support. There is a problem with this element in that the manner of obtaining the voids is complicated which involves carefully-controlled drying conditions of emulsions.

It is an object of this invention to provide a thermal recording element which has a more simpler and cheaper structure than those of the prior art. It is another object of the invention to provide a thermal recording element which does not involve complicated and carefully-controlled drying conditions of emulsions.

SUMMARY OF THE INVENTION

These and other objects are achieved in accordance with this invention which relates to a thermal recording element consisting of a support having thereon an opaque recording layer comprising hollow spherical beads dispersed in a hydrophilic binder, the beads having a mean diameter of about 0.2 $\mu$m to about 1.5 $\mu$m and a void volume of about 40% to about 90%.

The recording element appears opaque when coated because of the heterogeneous physical structure of the recording layer which contains voids filled with air inside the hollow beads. By applying heat and pressure by a thermal print head to the element, the hollow beads soften, coalesce and release the air in the voids. The resulting recording layer then becomes transparent and reveals the color of the underlying support generating a digital, continuous tone, monochrome image.

As compared to the prior art U.S. Pat. No. 2,739,909 which uses microscopic voids formed during the coating process, the current invention uses the voids in hollow spherical beads which have reasonable dimensional stability. The size of the particles and the void volume can be controlled by the preparation of the polymeric hollow beads. Most importantly, the coating process is very easy to handle for mass production and the behavior and microscopic physical structure of the film is easily predictable.

DESCRIPTION OF THE PREFERRED EMBODIMENTS

The hollow spherical beads which can be used in the invention can be made out of an acrylic ester polymers or copolymers. In a preferred embodiment, the beads are made out of a styrene-acrylic copolymer having a glass transition temperature of 60–110° C. available commercially from Rohm & Haas as Ropaque® Hollow Sphere Pigments. The hollow beads can be employed in an amount of from about 0.5 to about 5 g/m$^2$, preferably about 1.5 to about 3.0 g/m$^2$.

Any hydrophilic material may be used as the binder in the recording element employed in the invention. For example, there may be used gelatin, a poly(ethylene oxide), a poly (vinyl alcohol), a polyacrylic acid, a poly(vinyl pyrrolidone), polyvinylpyridine, poly(hydroxyethyl acrylate) or mixtures or copolymers thereof. In a preferred embodiment of the invention, the binder is gelatin or poly (vinyl alcohol). The binder can be employed in an amount of from about 0.4 to about 3.0 g/m$^2$, preferably from about 0.5 to about 1.6 g/m$^2$. A suitable surfactant such as Olin 10G® may be used if desired.

Any material can be used as the support for the recording element of the invention provided it is dimensionally stable and can withstand the heat of the thermal print head. Such materials include polyesters such as poly(ethylene naphthalate); polysulfones; poly(ethylene terephthalate); polyamides; polycarbonates; cellulose esters such as cellulose acetate; fluorine polymers such as poly(vinylidene fluoride) or poly(tetrafluoro-ethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 20 to about 200 $\mu$m. It can be transparent, colored or opaque such as a support coated with carbon black or dyes.

To make a black support, a carbon black dispersion in an organic solvent such as 4-methyl-2-pentanone containing Butvar® poly(vinyl acetal) as a binder can be coated with a laydown, e.g., of 0.32–1.08 g/m$^2$ of carbon and 0.32–1.08 g/m$^2$ of Butvar® poly(vinyl acetal). The recording layer containing the hollow beads can be coated on either the same side or the opposite side of the carbon black coating.

Another embodiment of the invention relates to a process of forming a single color image comprising imagewise-exposing, by means of a thermal print head, in the absence of a separate receiving element, the thermal recording element as described above, thereby imagewise-heating the recording layer and causing it to become transparent, thereby creating a single color image.

A thermal print head can be used to image the thermal recording elements of the invention, such as one with a heating voltage of 12–14 v and a heating speed of 17 ms/line for a 640 line image.

The recording elements of this invention can be used to obtain medical images, reprographic masks, printing masks, etc. The image obtained can be a positive or a negative image. The process of the invention can generate either continuous (photographic-like) or halftone images.

The following examples are provided to illustrate the invention.

EXAMPLES

Example 1

A dispersion was prepared comprising 6.67 g of carbon black in 4-methyl-2-pentanone containing Butvar-76® poly (vinyl acetal) as the binder (8.30 wt. % carbon black, 8.30 wt. % Butvar-76® poly(vinyl acetal) and 13.3g 4-methyl-2-pentanone). The resulting solution was coated on a poly (ethylene terephthalate) clear support with a final laydown of 0.54 g/m$^2$ of carbon black and 0.54 g/m$^2$ of Butvar-76® poly(vinyl acetal) to give a black support for the imaging layer.

Deionized wet gelatin (7.72 g) (11.5% by weight) was added to a solution containing 0.04 g surfactant Olin 10G® and 6.34 g water. The mixture was then heated at ~50° C. to make the gelatin melt. A 5.93 g water dispersion of hollow spherical styrene acrylic copolymer beads 1 (commercially available from Rohm & Haas as Ropaque® beads, 30% by weight, particle mean diameter 0.5 $\mu$m with 45% void volume, Tg 105° C.) was added to the above gelatin melt. The resultant dispersion was heated at 50° C. for 30 minutes and coated onto the black support mentioned above on the opposite side of the carbon black layer with a final laydown of 2.15 g/m$^2$ of the hollow beads 1 and 1.08 g/m$^2$ of gelatin. The coating was chill-set and allowed air-dry overnight before the imaging experiment was carried out.

A protective sheet was prepared by coating the following compositions in the order listed on one side of a 6 $\mu$m thick poly(ethylene terephthalate) support:

1) a subbing layer of Tyzor TBT®, a titanium tetrabutoxide, (DuPont Company) (0.16 g/m$^2$) coated from 1 -butanol; and
2) a slipping layer of 0.38 g/m of poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ of p-toluenesulfonic acid coated from a 3-pentanone/distilled water (98/2) solvent mixture.

The imaging element was imaged with a thermal resistive head in a stepwise fashion on the front side of the hollow bead image layer at a heating speed of 17 ms/line for a 640 line image and heating voltage of 13 v and total print head weight of 2.5 kg. The protective sheet was used between the recording element and the resistive head, with the bare side of the protective sheet being against the recording element.

The imaging electronics were activated causing the element to be drawn through the print head/roller nip at 10.84 mm/sec. Coincidentally, the resistive element in the print head were pulsed for 127.75 $\mu$s/pulse at 130.75 $\mu$s intervals during a 17.1 ms/dot printing cycle. A stepped image density was generated by incrementally increasing the number of pulses/dot from a minimum of 0 to a maximum of 127 pulses/dot. The voltage supplied to the thermal head was approximately 13.0 v resulting in an instantaneous peak power of 0.318 watts/dot and a maximum total energy of 5.17 mJ/dot; printing humidity: 42–45% RH. A black image was obtained on a white back ground as shown in Table 1 below.

Dark stability testing of the imaged samples was performed in a wet oven at 50° C., 50% RH for 5 days. Light stability test was carried out under irradiation with an energy of 50 Klux daylight for 5 days. Both the dark and light stability was evaluated based on the percent loss of the absorption maxima of the imaged (D-max) and nonimaged samples (D-min). The results are shown in Table 1 below.

Example 2

Deionized wet gelatin (7.72 g )(11.5% by weight) was added to a solution containing 0.04 g surfactant Olin 10G® and 5.56 g water. The mixture was then heated at ~50° C. to make the gelatin melt. A 6.71 g water dispersion of hollow spherical styrene acrylic copolymer beads 2 (commercially available from Rohm & Haas as Ropaque® beads, 26.5% by weight, particle mean diameter 1.0 $\mu$m with 55% void volume, Tg 104° C.) was added to the above gelatin melt. The resulted solution was heated at 50° C. for 30 minutes and coated onto the black support described in Example 1 on the opposite side of the carbon black layer with a final laydown of 2.15 g/m$^2$ of the hollow beads 2 and 1.08 g/m$^2$ of gelatin. The coating was chill-set and allowed air-dry overnight before the imaging experiment was carried out.

The imaging experiment similar to that described in Example 1 was carried out for the imaging element containing hollow beads 2 described above. The imaging element was imaged as in Example 1. A black-and-white image was obtained as shown in Table 1 below. The following results were obtained:

TABLE 1

| Hollow | Density (Status T Reflection) As Coated (Dmin) | | | Density (Status T Reflection) Imaged (Dmax) | | | Dark Stabiiity (Average % Change in) | | Light Stability (Average % Change in) | |
|---|---|---|---|---|---|---|---|---|---|---|
| Beads | C | M | Y | C | M | Y | D-max | D-min | D-max | D-min |
| 1 | 0.27 | 0.25 | 0.22 | 2.30 | 2.22 | 2.10 | −2.0 | −2.6 | −0.5 | 0.4 |
| 2 | 0.29 | 0.28 | 0.27 | 2.29 | 2.27 | 2.25 | −3.3 | −2.3 | −0.5 | 0.0 |

The above results show that the imaging element containing either hollow beads 1 or 2 gives a black-and-white continuous tone image on black supports with reasonable D-max and D-min and a high Dmax/D-min ratio (~7.8–9.5). Smaller size hollow beads 1 gives lower D-min (especially in the blue region) compared with hollow beads 2. Table 1 also shows that the images generated have good dark and light stability.

Example 3

Deionized wet gelatin (7.72 g ) (11.5% by weight) was added to a solution containing 0.04 g surfactant Olin 10G® and 5.56 g water. The mixture was then heated at ~50° C. to make the gelatin melt. A 6.67 g water dispersion of hollow spherical styrene acrylic copolymer beads 1 (as described in Example 1) was added to the above gelatin melt. The resulted solution was heated at 50° C. for 30 minutes and coated onto the black support described in Example 1 on the opposite side of the carbon black layer with a final laydown of 2.40 g/m$^2$ of the hollow beads 1 and 1.08 g/m$^2$ of gelatin. The coating was chill-set and allowed air-dry overnight before the imaging experiment was carried out.

The above imaging element was imaged with thermal resistive head at a printing speed of 17 ms/line for a 640 line image. The imaging experiment was carried out at constant voltage (11 v) but different weight of the print head ranging from 2.5 kg. to 3.9 kg. The results are shown in Table 2.

TABLE 2

| | Print Head Total Weight | ($D_{max}$) Density (Status T Reflection) After Imaging | | |
|---|---|---|---|---|
| Example | (kg) | C | M | Y |
| 1 | 2.5 | 1.46 | 1.39 | 1.29 |
| 2 | 2.9 | 1.79 | 1.70 | 1.59 |
| 3 | 3.4 | 1.86 | 1.78 | 1.66 |
| 4 | 3.9 | 1.95 | 1.85 | 1.72 |

The above results show that at constant thermal energy of the print head, the increase in head pressure enhances the imaging efficiency (D-max increases). Comparing the D-max values in Table 2 (head voltage 11 v) with those in Table 1 (head voltage 13 v), it is apparent that both heat and pressure influence the imaging efficiency.

The invention has been described in detail with particular reference to preferred embodiments thereof, but it will be understood that variations and modifications can be effected within the spirit and scope of the invention.

What is claimed is:

1. A thermal recording element consisting of a support having thereon an opaque recording layer comprising hollow spherical beads dispersed in a hydrophilic binder, said beads having a mean diameter of about 0.2 μm to about 1.5 μm and a void volume of about 40% to about 90%, said element containing an image formed from said hollow spherical beads which have been made transparent by heating with a thermal print head.

2. The recording element of claim 1 wherein said hollow spherical beads comprise an acrylic ester polymer or copolymer.

3. The recording element of claim 1 wherein said hollow spherical beads comprise poly(styrene-co-acrylic acid) having a glass transition temperature of 60–110° C.

4. The recording element of claim 1 wherein said hydrophilic binder is gelatin or poly(vinyl alcohol).

5. The recording element of claim 1 wherein said mean diameter is about 0.5 μm to about 1.0 μm.

6. The recording element of claim 1 wherein said void volume is about 45% to about 55%.

7. The recording element of claim 1 wherein said support has a black layer coated on the side opposite said recording layer.

8. A process of forming a single color image comprising imagewise-exposing, by means of a thermal print head, in the absence of a separate receiving element, a thermal recording element consisting of a colored support having thereon an opaque recording layer, said recording layer comprising hollow spherical beads dispersed in a hydrophilic binder, said beads having a mean diameter of about 0.2 μm to about 1.5 μm and a void volume of about 40% to about 90%, thereby imagewise-heating said recording layer and causing it to become transparent, thus creating said single color image.

9. The process of claim 8 wherein said hollow spherical beads comprise an acrylic ester polymer or copolymer.

10. The process of claim 8 wherein said hollow spherical beads comprise poly(styrene-co-acrylic acid) having a glass transition temperature of 60–110° C.

11. The process of claim 8 wherein said hydrophilic binder is gelatin or poly(vinyl alcohol).

12. The process of claim 8 wherein said mean diameter is about 0.5 μm to about 1.0 μm.

13. The process of claim 8 wherein said void volume is about 45% to about 55%.

14. The process of claim 8 wherein said support has a black layer coated on the side opposite said recording layer.

* * * * *